US008001749B2

(12) United States Patent
Negele

(10) Patent No.: US 8,001,749 B2
(45) Date of Patent: Aug. 23, 2011

(54) PACKAGING MACHINE HAVING A LIFTING UNIT

(75) Inventor: Wolfgang Negele, Ottobeuren (DE)

(73) Assignee: Multivac Sepp Hagggenmüller GmbH & Co. KG (DE)

( * ) Notice: Subject to any disclaimer, the term of this patent is extended or adjusted under 35 U.S.C. 154(b) by 86 days.

(21) Appl. No.: 12/454,029

(22) Filed: May 11, 2009

(65) Prior Publication Data

US 2009/0288365 A1 Nov. 26, 2009

(30) Foreign Application Priority Data

May 13, 2008 (DE) ..... 10 2008 023 319

(51) Int. Cl.
*B65B 31/00* (2006.01)
*B65B 9/04* (2006.01)
*B30B 1/18* (2006.01)

(52) U.S. Cl. ..... 53/510; 53/559; 53/329.3; 100/289; 100/290

(58) Field of Classification Search ..... 53/559, 53/561, 329.3, 510; 100/290, 289; *B65B 9/04; B30B 1/18*
See application file for complete search history.

(56) References Cited

U.S. PATENT DOCUMENTS

| | | | | | |
|---|---|---|---|---|---|
| 20,973 | A * | 7/1858 | Williams | 100/290 |
| 1,354,371 | A * | 9/1920 | Angier | 53/461 |
| 3,590,437 | A * | 7/1971 | Annis, Jr. et al. | 100/290 |
| 3,943,844 | A * | 3/1976 | Standbridge et al. | 100/290 |
| 4,036,152 | A * | 7/1977 | Bright | 100/289 |
| 4,537,230 | A * | 8/1985 | Schindel | 141/146 |
| 4,702,688 | A * | 10/1987 | Schenk | 100/290 |
| 5,282,732 | A * | 2/1994 | Eggert | 100/289 |
| 5,906,433 | A * | 5/1999 | Mazzalveri | 366/209 |
| 2003/0041560 | A1* | 3/2003 | Kemnitz | 53/331.5 |

FOREIGN PATENT DOCUMENTS

| | | | |
|---|---|---|---|
| CH | 516 993 | | 2/1972 |
| DE | 25 06 179 | | 8/1976 |
| DE | 24 27 249 | | 9/1976 |
| DE | 103 27 092 | | 12/2004 |
| DE | 10 2004 063 931 | | 1/2006 |
| EP | 0 352 466 | | 1/1990 |
| JP | 08-217007 | | 8/1996 |
| JP | 2008001408 | A * | 1/2008 |
| WO | WO-98/10918 | | 3/1998 |

OTHER PUBLICATIONS

Machine translation of FR 2072794, corresponds to CH 516993, retrieved from http://translationgateway.epo.org/emtp/gw/?ACTIO...RMAT=docdb&COUNTRY=FR&NUMBER=2072794&KIND=A5&T=1, Mar. 3, 2011, 3 pages.*

* cited by examiner

*Primary Examiner* — Stephen F Gerrity
(74) *Attorney, Agent, or Firm* — Brooks Kushman P.C.

(57) ABSTRACT

A packaging machine having a lifting unit comprises at least a spindle and a spindle nut. It is the object of the present invention to provide a packaging machine having a lifting unit which can substantially receive the same forces in any lift position and which exhibits shorter moving times. For this reason, the spindle is motor-drivable and stationary relative to a frame (2).

20 Claims, 4 Drawing Sheets

PACKAGING MACHINE HAVING A LIFTING UNIT

The present invention relates to a packaging machine having a lifting unit, and in particular to a traysealer or a thermoformer.

In the field of packaging machines, lifting units are known using toggle lever mechanism to realize the lift movement. These systems can receive different large forces according to the lift position and the angle position, respectively, of the lever system by shifting the force application point, which is disadvantageous especially for sealing stations having variable sealing height. Rather, a constant sealing pressure is desired here, which can be generated at any operating point.

Further, lifting units having spindle drives are known. In order to receive the high forces acting in the sealing station, for instance, the diameters of the spindles must be sized large enough by taking the safety factor against buckling into account. This affects the dynamics of the system such as the moving times and therefore the cycle performance of the packaging machine. Moreover, commonly known spindle lifting units require unfavourable installation heights, since the spindles perform the needed vertical movement.

Hence, it is the object of the present invention to provide a packaging machine having a lifting unit which can substantially receive the same forces at any lifting position and exhibits shorter moving times.

By the spindle drive according to the invention, large forces can be received at any lift position in the individual working stations of the packaging machine. For instance, the closing movement of a lower tool towards a stationary upper tool can be optimally measured and controlled in this manner.

Since the spindle nut performs the vertical movement and the spindle is kept stationary according to the configuration of the present invention, the same is exclusively stressed by tension, that is, the risk of buckling is excluded. In this manner, the diameter of the spindle can be sized relatively small, which is an advantage in favour of the dynamics of the systems such as the moving times of the lifting unit and therefore the cycle performance of the packaging machine. Since the spindle is kept stationary, the installation height of the lifting unit can be kept small.

By guiding rods, which exclusively perform a vertical movement, the overall system of the lifting unit can be sealed by simple and therefore inexpensive materials. Since the spindle is kept stationary in operation of the lifting unit, only a housing cover of the lifting unit must be provided with O-seals such as wipers for the guiding rods. In this manner, the lifting unit forms an enclosed and therefore hygienic unit.

Figure 1:
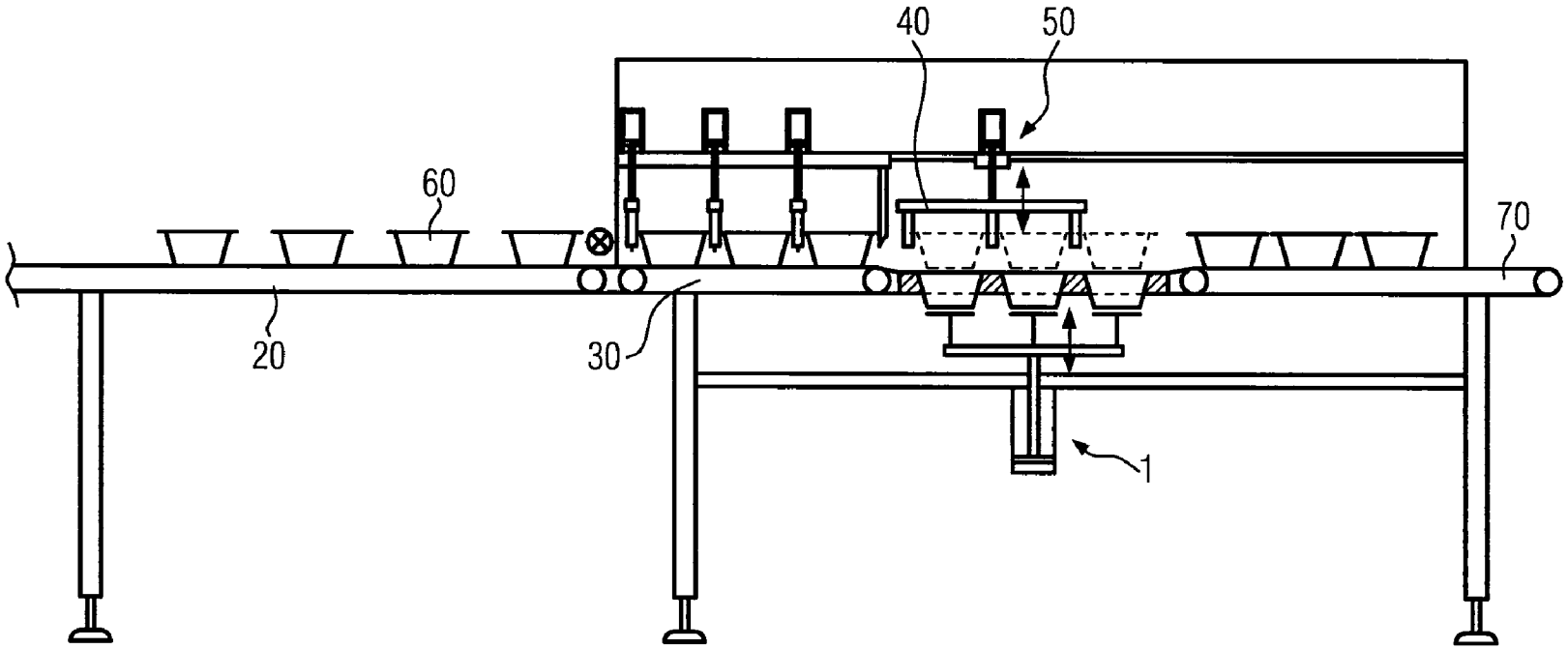
Figure 2:
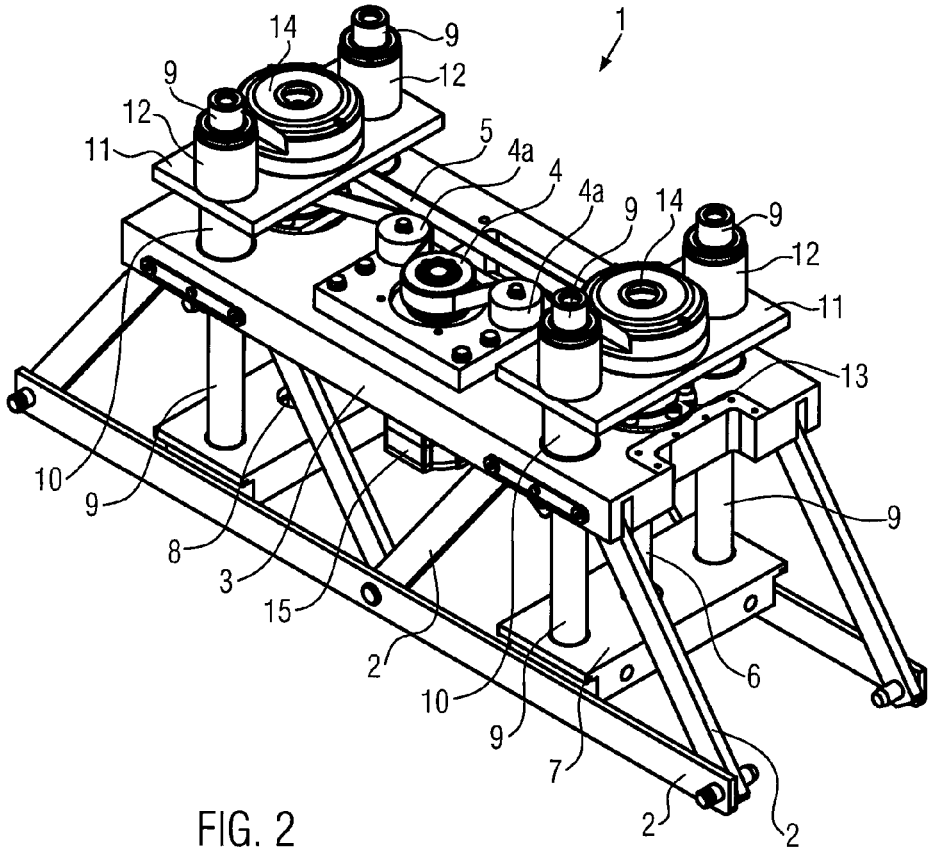
Figure 3A:
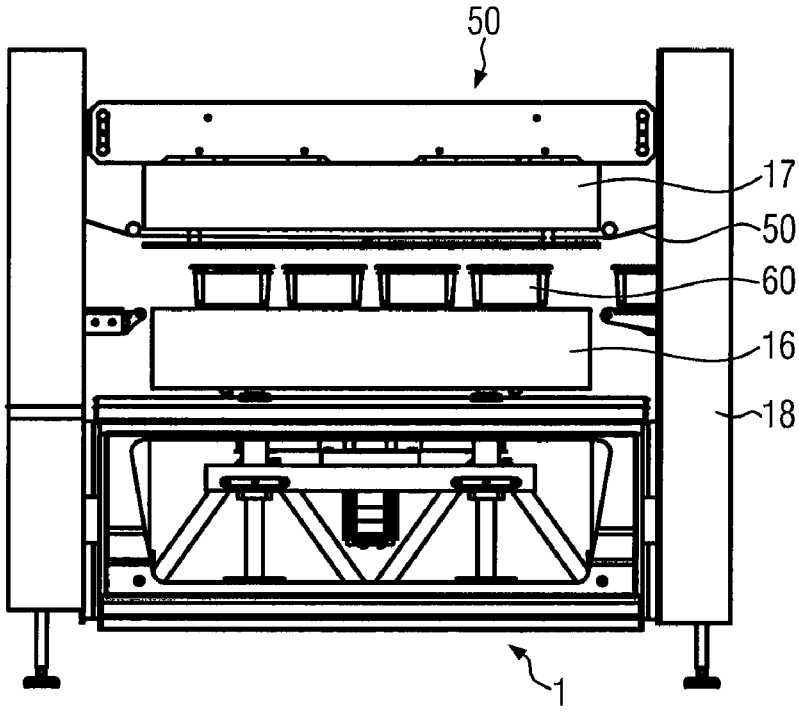
Figure 3B:
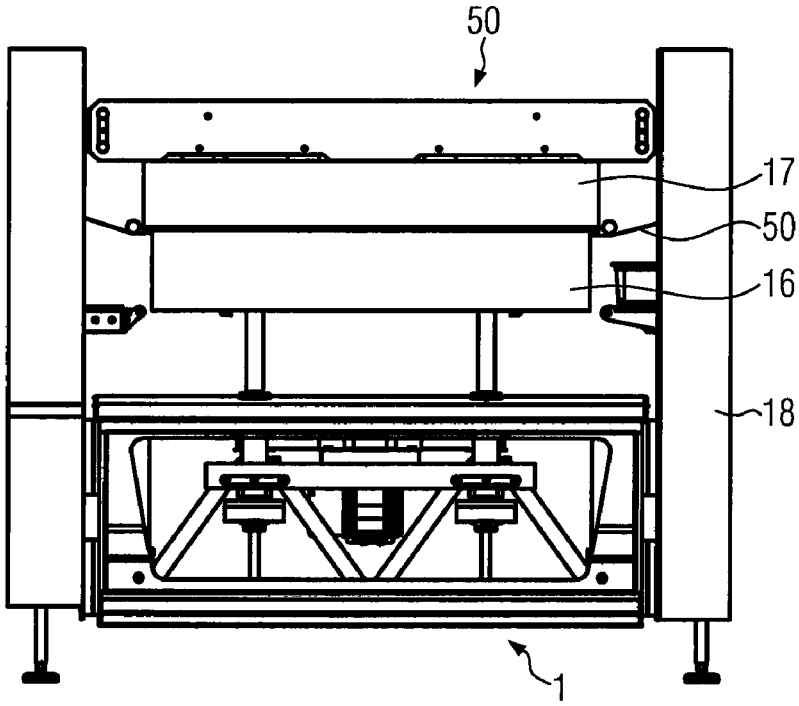
Figure 4A:
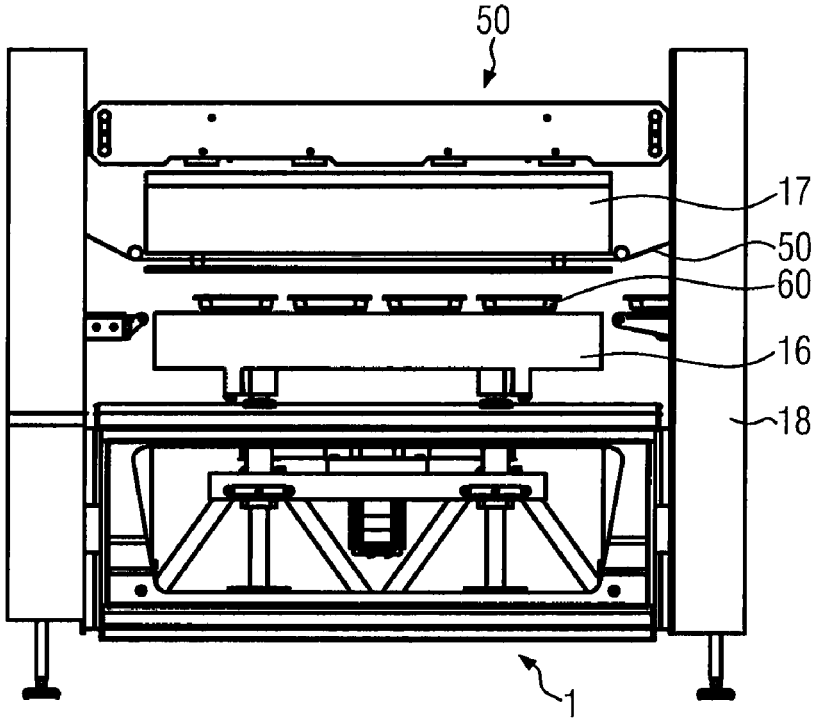
Figure 4B:
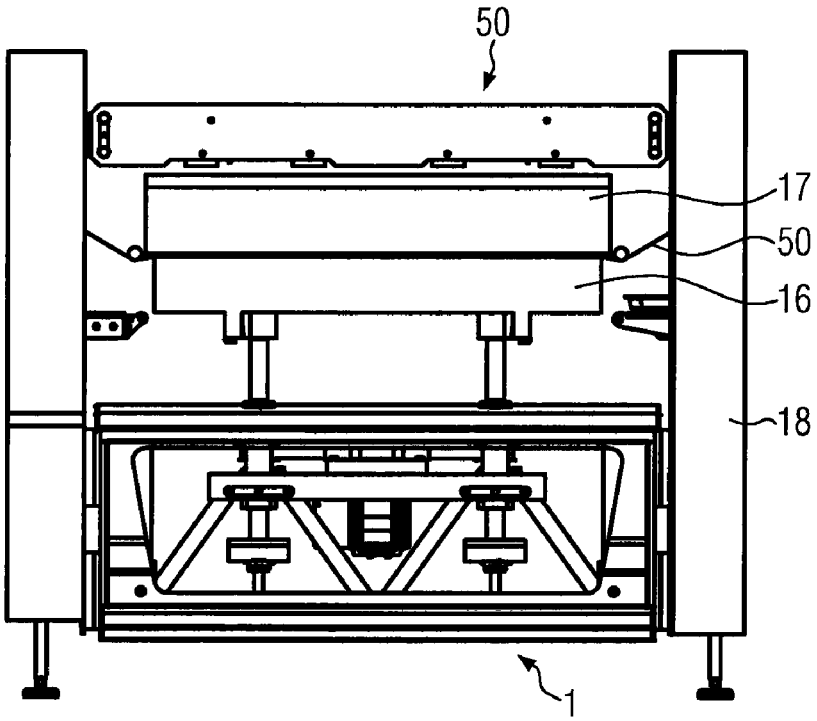

Further features and utilities of the invention can be gathered from the description of embodiments on the basis of the enclosed Figures. In the Figures show:

FIG. 1 a schematic side view of a packaging machine;

FIG. 2 a schematic perspective view of the lifting unit;

FIG. 3*a* a schematic side view of the lifting unit in the lowered position having an upper tool in a first position;

FIG. 3*b* a schematic side view of the lifting unit in a lifted position having an upper tool in a first position;

FIG. 4*a* a schematic side view of the lifting unit in the lowered position having an upper tool in a second position;

FIG. 4*b* a schematic side view of the lifting unit in the lifted position having an upper tool in a second position.

In the following, a first embodiment of the invention is described with reference to FIGS. 1 through 3*b* on the basis of a traysealer.

FIG. 1 shows a traysealer having a first belt conveyor 20, a second belt conveyor 30, a third belt conveyor 70, a picker 40, an evacuation- and sealing station 50 and a lifting unit 1.

In operation, packages 60 are transferred by the first belt conveyor 20 to the second belt conveyor 30. The packages 60 are conveyed by the picker 40 into the evacuation- and sealing station 50. Sealing is performed by lifting the packages 60 by the lifting unit 1. The evacuated and sealed packages 60 are then removed by the third belt conveyor 70.

FIG. 2 shows the lifting unit 1 in a schematic perspective view. A support plate 3 forms together with a frame 2 a trapezoidal basis assembly of the lifting unit 1 as viewed in the side view. On the upper side of the support plate 3, a drive roller 4 and two deflection rollers 4*a* are provided, which are raised on a further small plate, such that the drive roller 4 is substantially disposed between both deflection rollers 4*a*. The drive roller 4 is connected to a motor 15 such as an electric servo motor via a drive shaft (not shown). The motor 15 is disposed below the support plate 3.

The lifting unit 1 is substantially symmetrical with respect to a plane extending through the rotational axis of the drive roller 4 and the centres of the longitudinal edges of the upper side of the support plate 3. The support plate 3 has three bores at each of both smaller sides. Each of the central bores supports a spindle 6 by a spindle bearing 13. Both spindles 6 extend downwards through the central bores in the support plate 3. The spindles 6 cooperate with two spindle nuts 8 provided in central bores of two lifting plates 7. The lifting plates 7 in turn are fixedly provided with two guiding rods 9 extending upward through both above-mentioned outer bores which are provided at the smaller sides of the support plate 3. For a translational guidance of the guiding rods 9, linear guides 10 are embedded in the support plate 3 and extend further upward, respectively, and they pass through one or through a total of two counter plates 11. At these counter plates 11, a brake 12 is provided for each guiding rod 9, the brakes enclose the guiding rods 9 and shall avoid undesired lowering of the lifting unit 1, when the same is lifted during operation. The brakes 12 are electro-magnetically released, for instance, and they are operated by spring force. For safety reasons, the brakes 12 are independently operateable with respect to the rest of the system. Moreover, a counter-bearing 14 to bear the spindles 6 is provided at each counter-plate 11.

In operation, the spindles 6 are driven by a belt 5 such as a tooth belt which is driven by the drive roller 4. The belt 5 can be tensioned or tensioned on demand by the deflection rollers 4*a*, which are eccentrically supported. The belt further assures that both spindles 6 are synchronously driven and that the lifting unit 1 is not tilted.

In operation of the lifting unit 1, the motor 15 drives the drive roller 4, and the drive roller in turn drives the belt 5. Both spindles 6 are rotated in this manner according to the moving direction synchronously in the corresponding direction. The spindles 6 cooperate with the spindle nuts 8, and the lifting plates 7 are lifted and lowered together with the guiding rods 9. The guiding rods 9 are connected at the upper end thereof with a lower tool 16 (see FIGS. 3*a* to 4*b*), and they lift it up and lower it down. The guiding rods 9 are embodied as tubes and receive in the inside thereof supply-, waste- or control pipes such as gas pipes for gassing or evacuating a chamber of a packaging machine, which is formed by a lower tool 16 and an upper tool 17 (see FIGS. 3*a* to 4*b*). The hollow guiding rods 9 themselves may serve as pipes. As soon as the lifting unit reaches the desired lifted end position, the brakes 12 are locked. For safety reasons, the process such as sealing is continued only thereafter.

FIG. 3*a* shows a schematic side view of the lifting unit integrated in a frame 18 of an evacuating- and sealing station 50. The lifting unit 1 and the lower tool 16 having the already filled packages 60 disposed thereon are located in a lowered position. The upper tool 17 is stationary. In operation, the lifting unit 1 is disposed within a closed housing. The bores for the guiding rods 9 are in a close contact with the guiding rods 9. In this manner, a hygienic configuration is formed.

FIG. 3*b* shows the lifting unit 1 and the lower tool 16 in a lifted position. In this position, the packages 60 (see FIG. 3*a*) are sealed.

FIG. 4*a* shows a similar construction to FIG. 3*a*. Here, the packages 60 are flatter, and therefore, the upper tool 17 is located in a lower position with respect to the position as described in FIGS. 3*a*, 3*b*. In this manner, an unnecessary lifting stroke is avoided, whereupon the cycle performance of the packaging machine can be increased. It is also conceivable to design a upper tool 17 which can be automatically moved.

FIG. 4*b* shows the lifting unit 1 and the upper tool 16 in a lifted position, respectively. In this position, the packages 60 (see FIG. 4*a*) are sealed.

The invention is not restricted for use in a traysealer. Rather, it is also applicable to a thermoformer or chamber machine.

The lifting unit is not restricted to the described embodiment. It is applicable in any working stations of a packaging machine. For example, it is conceivable that the upper tool is lowered and lifted, respectively, and that the lower tool is stationary.

It is also conceivable to provide only one spindle to realize the lifting movement of the lifting unit.

The invention claimed is:

1. A packaging machine having a lifting unit, the lifting unit comprising:

a frame;

a rotatable spindle that is vertically stationary relative to the frame;

a spindle nut that receives the spindle, the spindle nut being raisable by rotation of the spindle;

a drive roller for rotating the spindle, wherein the drive roller is arranged above the spindle nut;

a movable tool that is configured to lift packages received in the packaging machine;

a motor that drives the drive roller; and a guiding rod associated with the spindle nut such that the guiding rod extends above the spindle nut and is raisable with the spindle nut, the guiding rod having an upper end connected to the tool.

2. The packaging machine according to claim 1, wherein the lifting unit further comprises a lifting plate, and the spindle nut is provided in the lifting plate.

3. The packaging machine according to claim 2, wherein the lifting unit further comprises an additional guiding rod, and the guiding rods can be lifted and lowered by the lifting plate.

4. The packaging machine according to claim 3, wherein the tool is a lower tool and the additional guiding rod is connectable to the lower tool.

5. The packaging machine according to claim 3, wherein the lifting unit further comprises an electro-magnetically releasable brake that is provided around one of the guiding rods.

6. The packaging machine according to claim 3, wherein the guiding rods are hollow.

7. The packaging machine according to claim 3, further comprising supply-, waste- or control pipes that are provided in the guiding rods.

8. The packaging machine according to claim 3, wherein the guiding rods are formed as supply-, waste- or control pipes.

9. The packaging machine according to claim 2, wherein the guiding rod is connected to the lifting plate and extends above the lifting plate, the lifting unit further comprises a counter-plate arranged above the lifting plate that receives the guiding rod, and a bearing on the counter-plate that receives the spindle, and wherein the tool is disposed above the bearing.

10. The packaging machine according to claim 1, wherein the spindle nut is embodied as a lifting plate.

11. The packaging machine according to claim 1, wherein the lifting unit further comprises an additional rotatable spindle and an additional spindle nut that receives the additional spindle, the additional spindle nut being raisable by rotation of the additional spindle.

12. The packaging machine according to claim 11, wherein the spindles are synchronously drivable.

13. The packaging machine according to claim 11, further comprising a tension means by which the spindles are synchronously drivable.

14. The packaging machine according to claim 11, wherein the spindles are drivable independently to each other.

15. A packaging machine for sealing packages, the packaging machine comprising:

a sealing station having an upper tool and a lower tool that are configured to seal the packages; and a lifting unit for raising and lowering one of the tools, the lifting unit comprising a frame, first and second rotatable spindles that are vertically stationary relative to the frame, a drive roller that is configured to rotate the spindles, a motor connected to the drive roller for rotating the drive roller, first and second lifting plates that receive the first and second spindles, respectively, and that are configured to be raised and lowered by rotation of the spindles, and multiple guiding rods associated with each lifting plate such that each guiding rod is movable with a respective one of the lifting plates, each guiding rod having a lower end connected to one of the lifting plates and an upper end disposed above the lower end and connected with the one tool, wherein the drive roller is arranged above the lower ends of the guiding rods.

16. The packaging machine according to claim 15 wherein the lifting unit further comprises multiple electro-magnetically releasable brakes associated with the guiding rods, each brake being independently operable to hold a respective guiding rod in a desired position.

17. The packaging machine according to claim 15, wherein the lifting unit further comprises a support plate positioned above the lifting plates, and the drive roller is mounted on the support plate.

18. The packaging machine of claim 15 wherein at least one of the guiding rods is hollow and comprises a gas pipe for supplying gas to or evacuating gas from the packages while the packages are in the sealing station.

19. A packaging machine having a lifting unit, the lifting unit comprising:

a frame;

a rotatable spindle that is vertically stationary relative to the frame;

a spindle nut that receives the spindle, the spindle nut being raisable by rotation of the spindle;

a drive roller for rotating the spindle, wherein the drive roller is arranged above the spindle nut;

a lifting plate in which the spindle nut is provided;

a guiding rod connected to the lifting plate and extending above the lifting plate;

a counter-plate arranged above the lifting plate that receives the guiding rod;

a bearing on the counter-plate that receives the spindle; and a tool disposed above the bearing and connected to the guiding rod.

20. The packaging machine according to claim 19, wherein the lifting unit further comprises a support plate positioned between the lifting plate and the counter-plate, and the drive roller is mounted on the support plate.

* * * * *